US008609583B2

(12) United States Patent
Hoggard

(10) Patent No.: US 8,609,583 B2
(45) Date of Patent: Dec. 17, 2013

(54) SUBLIMATION PRINTING

(76) Inventor: Peter John Hoggard, Wiltshire (GB)

( * ) Notice: Subject to any disclaimer, the term of this patent is extended or adjusted under 35 U.S.C. 154(b) by 218 days.

(21) Appl. No.: 13/122,279

(22) PCT Filed: Oct. 5, 2009

(86) PCT No.: PCT/GB2009/051310

§ 371 (c)(1),
(2), (4) Date: Jun. 13, 2011

(87) PCT Pub. No.: WO2010/038089

PCT Pub. Date: Apr. 8, 2010

(65) Prior Publication Data

US 2011/0229664 A1 Sep. 22, 2011

(30) Foreign Application Priority Data

Oct. 3, 2008 (GB) ..... 0818109.1

(51) Int. Cl.
*B41M 5/382* (2006.01)
*B41J 2/435* (2006.01)

(52) U.S. Cl.
USPC ..... 503/227; 347/224

(58) Field of Classification Search
USPC ..... 503/227
See application file for complete search history.

(56) References Cited

U.S. PATENT DOCUMENTS

| | | | | |
|---|---|---|---|---|
| 4,662,966 | A * | 5/1987 | Sumi et al. | 156/230 |
| 6,656,230 | B1 | 12/2003 | Zaher | |
| 2002/0148054 | A1 | 10/2002 | Drake | |

FOREIGN PATENT DOCUMENTS

| | | |
|---|---|---|
| DE | 198 04 218 | 8/1999 |
| EP | 2 344 336 B1 | 7/2011 |
| FR | 2 214 263 | 8/1974 |
| GB | 2 442 824 | 4/2008 |
| WO | WO 96/29208 | 9/1996 |
| WO | WO 2004/106082 | 12/2004 |
| WO | 2006/050902 | 5/2006 |
| WO | 2006/053730 | 5/2006 |
| WO | 2007/049070 | 5/2007 |
| WO | WO 2009/001034 A1 | 12/2008 |

OTHER PUBLICATIONS

International Search Report for PCT/GB2009/051310, mailed Mar. 22, 2010.
Written Opinion of the International Searching Authority for PCT/GB2009/051310, mailed Mar. 22, 2010.
Search Report for GB0818109.1, searched Oct. 12, 2008.

* cited by examiner

*Primary Examiner* — Bruce H Hess
(74) *Attorney, Agent, or Firm* — Nixon & Vanderhye P.C.

(57) ABSTRACT

A sublimation printing apparatus (1) which includes a tray (2) for receiving a three dimensional object (10) having a film (12) carrying sublimable ink, an infrared heater (3) mounted adjacent the tray (2) and a airflow inducing device (4). The infrared heater (3) is operable to direct infrared radiation toward the tray (2). The airflow inducing device (4) is operable to induce a flow of air across the film (12).

26 Claims, 7 Drawing Sheets

SUBLIMATION PRINTING

This application is the U.S. national phase of International Application No. PCT/GB2009/051310, filed 5 Oct. 2009, which designated the U.S. and claims priority to Great Britain Application No. 0818109.1, filed 3 Oct. 2008, the entire contents of each of which are hereby incorporated by reference.

This invention relates generally to sublimation printing and more specifically to a method and apparatus of sublimation printing.

Ink sublimation printing is known as a method of applying decorative transfers, print, photographs and other images to surfaces and articles.

Sublimation is when a substance, in this case an ink or dye, transitions between the solid and gas state without passing through the liquid state. In the ink sublimation printing process, the ink is heated until it sublimes into a gas, diffuses onto the printing media and solidifies.

The application of pressure to the printing media is often used to assist in the ink transfer, for example by using heated rollers or a hot platen press. It is problematic to achieve good ink sublimation printing to three dimensional articles as it is difficult for pressure and heat to be applied evenly to a three dimensional structure. It is necessary for each surface of the article to which print is to be applied, to have evenness of pressure and heat.

There is a desire to produce uniformly printed articles by the ink sublimation technique with faster printing process and with the possibility of being able to print a number of articles during the same ink sublimation process.

WO 2007/049070 describes a sublimation printing process and associated apparatus which attempt to alleviate the above-mentioned problems. This document describes a sublimation printing apparatus with a movable chamber for housing a three dimensional object to be printed, a film carrying sublimable ink positioned adjacent the object, two heater units each including a fan for directing heated air onto the film.

In use, the chamber is positioned under the first heater which applies heat to thermoform the film over the object. The object is then moved to a position beneath the second heater, which applies high velocity or turbulent flow of hot air at a higher temperature to enable sublimation of the ink onto the object.

Whilst the results achieved with this arrangement are better than previous devices, it is somewhat difficult to regulate the temperature to achieve a uniform distribution over the entire film during the thermoforming stage of the process. In an effort to achieve a more uniform temperature distribution, the arrangement must be enclosed to maintain a controlled environment.

This requires the film to be hidden, which in turn makes it difficult for the operator to judge whether the film is ready to be subjected to the high velocity or turbulent flow of hot air at the image transfer (i.e. sublimation) stage. If air becomes trapped between the film and the object, the air expands which can lead to poor image transfer and even rupture of the film, resulting in machine downtime and a rejected part. These problems also become more prevalent as the film increases in size.

Accordingly, a first aspect of the present invention provides a sublimation printing apparatus comprising a substrate for receiving a three dimensional object having a film carrying sublimable ink thereon, an infrared heater mounted adjacent the substrate and airflow inducing means, wherein the infrared heater is operable to direct infrared radiation toward the substrate, e.g. for heating the film to thermoform it over the object and/or for heating the film to enable sublimation of the ink to the object, the airflow inducing means being operable to induce a flow of air onto and/or over and/or across the film The use of an infrared heater is advantageous for two reasons, first the temperature of the film can be increased rapidly and second there is no need to provide an enclosed environment due to the direct nature of the application of heat. However, since infrared radiation is directional, its application over three dimensional objects can be problematic. It has also been observed that the airflow inducing means breaks down the boundary layer over the film surface and therefore encourages efficient heat transfer across the film. Thus, the provision of the apparatus of the present invention advantageously provides a synergistic combination of infrared heat and airflow to optimise the application of heat to the film.

The airflow inducing means may be configured to induce a high velocity flow of air. In some embodiments, the airflow inducing means is positioned to induce a flow of air, for example a high velocity flow of air, e.g. through or around the infrared heater and/or the infrared heater may be shaped to restrict the airflow and/or to create a high velocity airstream, for example an airknife.

A second aspect of the invention provides a sublimation printing apparatus comprising an enclosure, a substrate within the enclosure for receiving a three dimensional object to be printed with a film carrying sublimable ink positioned adjacent thereto, airflow inducing means operable to induce a flow of air onto or over or across the film and a restrictor for restricting the flow of air induced by the airflow inducing means thereby to create a high velocity airstream, for example an airknife directed toward the film.

The infrared heater may comprise a heating element at least partially surrounded by a reflector, for example wherein the reflector is shaped to at least partially restrict the airflow and/or to create the a high velocity airstream or airknife. The apparatus or infrared heater may further comprise louver means, e.g. for selectively opening or closing the flow of air through the infrared heater. The louver means may comprise one or more louver plates, for example which are slidably or pivotably connected to the reflector or reflectors.

The infrared heater may comprise a second heating element, for example which is at least partially surrounded by a second reflector. The second reflector may be adjacent but separate from the first reflector to provide a gap therebetween. The airflow inducing means can then be positioned to induce a flow of air through the gap, for example to create the high velocity airstream or airknife. The reflectors may be cooperably shaped to create a throttling or restricting effect as the flow of air passes between them and through the gap, e.g. to create the high velocity airstream or airknife. The gap or size of restriction is preferably between 0.25 millimeters and 5 millimeters, for example between 0.5 millimeters and 4 millimeters, more preferably between 0.75 millimeters and 3 millimeters and most preferably between 1 millimeter and 2 millimeters.

The portion of the infrared heater or reflector or reflectors which is shaped to restrict or to at least partially causes the high velocity airstream or airknife may be tapered or convex. The or each reflector may be arranged and/or configured and/or shaped and/or sized and/or dimensioned to direct infrared radiation emitted by the heating elements, for example toward the film in use.

The apparatus may further comprise an airflow heater, for example adjacent the airflow inducing means, for heating the air flowing over the film. The airflow heater may be adjustable to provide variable heating, e.g. hot or warm flow of air, for example during the first or second heating stages, e.g. the thermoforming or sublimation stages, or non-heated flow of air, for example to regulate the film temperature during the first or second heating stages, e.g. the thermoforming or sublimation stages, and/or to cool the part after the second heating stage, e.g. the sublimation stage.

The airflow inducing means may be operable to provide high velocity air flow, for example turbulent flow of air. Additionally or alternatively, the airflow inducing means may be operable to provide two or more different flow velocities. For example, the airflow inducing means may comprise a fan, for example a centrifugal fan, a pump or a blower which may comprise an inverter to provide the two or more different flow velocities. Advantageously, the airflow inducing means may comprise two or more centrifugal fans arranged adjacent or opposite one another so as to provide a flow of air across and/or through the infrared heater and/or to provide a turbulent flow of air around the object.

The airflow inducing means preferably comprises at least one pair of opposed centrifugal fans.

A third aspect of the invention provides a sublimation printing apparatus comprising an enclosure, a substrate within the enclosure for receiving a three dimensional object to be printed with a film carrying sublimable ink positioned adjacent thereto, airflow inducing means operable to induce a flow of air onto or over or across the film, an airflow heater for heating the flow of air induced by the airflow inducing means, wherein the airflow inducing means comprises at least one centrifugal fan positioned at each end of the enclosure with their outlets facing one another.

The centrifugal fans may be positioned with their outlets above the infrared heater and their inlets below the infrared heater. The or an enclosure may arranged above or around the infrared heater, wherein the fans may be positioned at opposite ends or sides of the enclosure. The fans may be positioned at opposite lateral sides of the enclosure with their inlets facing one another. The apparatus may further comprise a second pair of opposed centrifugal fans, for example positioned at the opposite longitudinal end of the enclosure to the first pair of fans, the inlets of the second pair of fans may be located below the infrared heater while the outlets of the second pair of fans may be located above the infrared heater and/or facing the outlets of the first pair of fans.

The or an enclosure may house the infrared heater and/or the airflow inducing means and/or the airflow heater and/or the plenum. Where the airflow inducing means comprises two centrifugal fans, their outlets may face each other and/or be above and/or face across the infrared heater and/or with their inlets below and/or facing across the infrared heater. The arrangement may be arranged to provide a flow of air across and/or through the infrared heater and/or to provide a turbulent flow of air around the object. The enclosure may comprise ducting means, for example to control the position of the inlet or inlets of the or a centrifugal fan or fans.

The airflow inducing means may be operable to induce a flow of air, for example a low velocity flow of air, over the film as it is thermoformed over the object, for example to regulate or equalise the temperature distribution along or across the film and/or to provide further heating of the film. The airflow inducing means may be operable to induce a flow of air, for example a high velocity or turbulent flow of air, over the film as the ink sublimates to the object, for example to heat the film and surface quickly.

The apparatus may further comprise a control unit, for example to control, in use, the operation of the infrared heater and/or the airflow inducing means and/or the airflow heater.

A further aspect of the invention provides a control unit for use in the apparatus.

The apparatus may further comprise a plenum, for example which is upstream of the gap, for distributing the or a flow of air from the airflow inducing means across the film. The plenum may comprise two or more plates, e.g. having progressively smaller and more numerous apertures, for spreading or distributing the flow of air, e.g. more evenly, across the film.

The apparatus may be provided with a vacuum pump, for example which is fluidly connected to the substrate, e.g. for providing a vacuum effect between the film and the surface of the object. The apparatus may further comprise a tray which includes the substrate and/or which may be substantially sealed or sealable, in use, against the enclosure.

The apparatus may also be provided with a series of louvers between the airflow inducing means and the heater for preventing the flow of air to the object. The louvers may be operable to open and close as required.

The apparatus may comprise two or more stations, for example wherein the substrate may be movable such as between the two or more stations, e.g. by means of a conveying and/or lifting means such as a conveyor and/or scissor lift arrangement or mechanism. One of the stations may be configured to thermoform, in use, the film over the object, another may be configured to sublimate, in use, the film over the object and/or another may be configured to cool the object and/or the film. Any advantageous combination of these stations is also envisaged. For example, the apparatus may comprise a first station configured to thermoform and sublimate, in use, the film over the object and a second station configured to cool the object and/or the film. Alternatively, the first station may comprise a thermoforming and cooling station with the second station comprising a sublimation station.

A further aspect of the invention provides a method of sublimation printing comprising placing a film carrying sublimable ink adjacent an object, heating the film to a first temperature such that it thermoforms over a surface of the object and subsequently heating the film and/or the surface and/or the object to a second, higher temperature such that the ink sublimates to the or a surface of the object, wherein the film and/or the object is exposed to infrared heat during one or both of the heating stages and to a flow of air during or after one or both of the heating stages.

The film and/or the object may be exposed to infrared heat to heat it to the first temperature and/or to a high velocity flow of heated air to heat it to the second, higher temperature.

Preferably, the film and/or surface and/or object is exposed to a flow of air, e.g. a heated or warm or hot flow of air, during one or both of the heating stages. More preferably, the film and/or surface and/or object is exposed to a warm and/or low velocity flow of air during the first heating, e.g. thermoforming, stage and/or to a hot and/or high velocity or turbulent flow of air during the second heating, e.g. sublimation, stage.

Additionally or alternatively, the film and/or surface and/or object may be exposed to a non-heated flow of air, for example a high velocity or turbulent flow of air, after the second heating, e.g. sublimation, stage for cooling the object and film.

The flow of air may comprise an airknife, which may be created by cooperating adjacent portions of the infrared heater, for example adjacent reflectors, e.g. which create a restriction.

Yet further aspects of the invention provide a film carrying sublimable ink specifically adapted for use with the apparatus and an object printed using an apparatus or by a method as described above.

Embodiments of the present invention will now be described by way of an example only with reference to the accompanying drawings in which.

Figure 1:
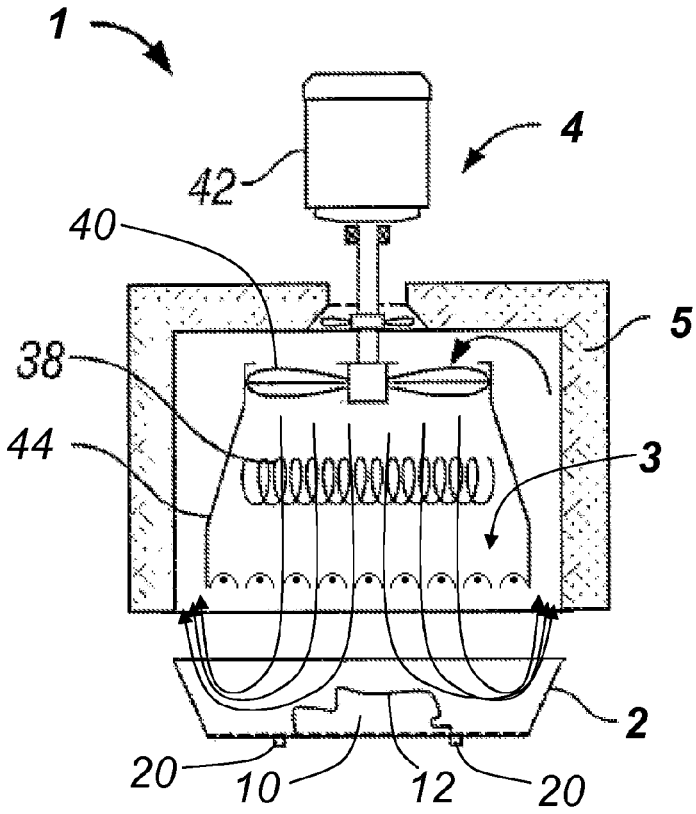
FIG. 1 is a diagrammatic section view through an ink sublimation printing apparatus in accordance with a first embodiment of the invention shown during the thermoforming stage.
Figure 2:
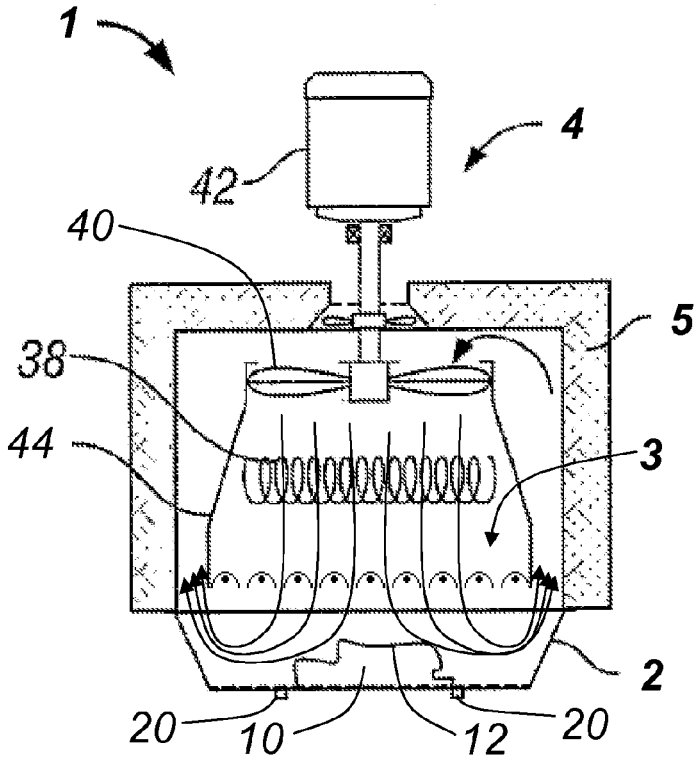
FIG. 2 illustrates the apparatus of FIG. 1 during the sublimation stage.
Figure 3:
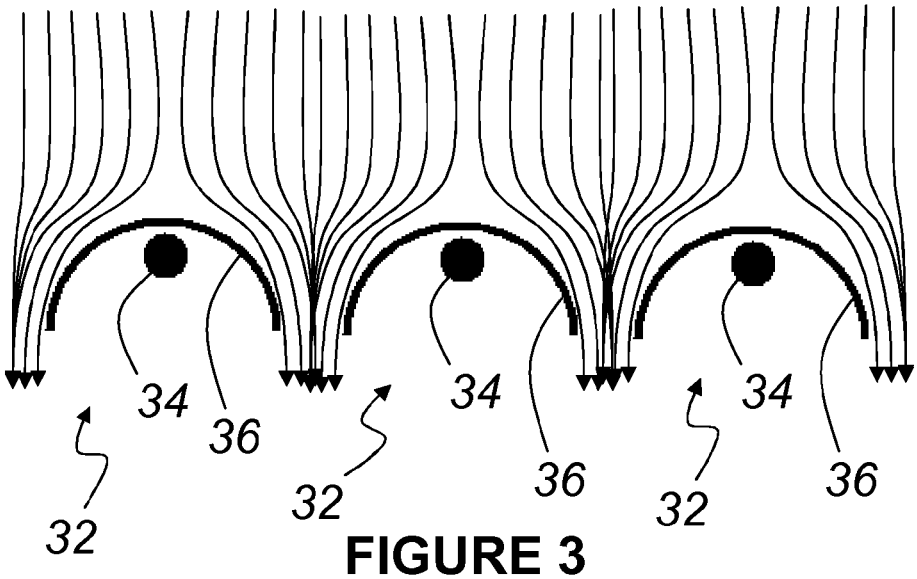
FIG. 3 is an enlarged view of adjacent infrared heating elements of the apparatus of FIG. 1 showing the flow of air around the reflectors.

Referring to FIGS. 1 to 3, there is shown a sublimation printing apparatus 1 which includes an infrared heater 3, an airflow inducing means 4 and an airflow heater 38 all of which are housed within an insulated enclosure 5 having an open bottom. The apparatus also includes a steel tray 2 positioned below the enclosure 5 within which there is placed a three dimensional object 10 to be printed and a film 12 positioned on top of the object 10.

The film 12 contains the desired sublimable inks and is positioned over the object 10 and clamped in position at its edges via a clamp 20. The clamp 20 provides a seal between the film 12 and the tray 2. It is also envisaged that the clamp 20 and the tray 2 may include locating pins for ensuring correct location thereof, although these are not shown in the attached Figures.

The infrared heater 3 is mounted at the base of the enclosure 5 and includes a plurality of longitudinal infrared heaters 32, each of which includes an elongate heating element 34 partially surrounded by a reflector 36 having a semi-circular cross section. The heating elements 34 in this embodiment are coiled wire quartz tubes. This type of heating element 34 is advantageous since it offers rapid heating and cooling and offer a choice of different wavelengths; short, medium and long wave. The heaters 32 run parallel and are placed adjacent one another such that a gap is present between adjacent reflectors 36. The reflectors 36 are orientated to reflect the infrared radiation emitted from the heating elements 34 downwardly toward the film 12 on the object 10 in the tray 2.

The airflow inducing means 4 in this embodiment is in the form of a fan or blower 40 powered by an electric motor 42. The electric motor is rotatably mounted to the top of the enclosure 5 and includes a shaft which extends into the enclosure 5 and drives the fan 40. The electric motor 42 also includes an inverter (not shown) and is configured to provide selectively a low flow rate or a high flow rate. Similarly, the airflow heater 38 is adjustable for controlling the temperature of the flow of air induced by the fan 40. Both the airflow heater 38 and the fan 40 are located within a steel airflow chamber 44. The airflow chamber 44 directs the flow of air induced by the fan 40 through the airflow heater 38 and through the gaps between the reflectors 36 of the infrared heaters 32 as represented in FIGS. 1 and 2.

The apparatus 1 also includes a control unit (not shown) to which the infrared heater 3, the fan 4 and the airflow heater 38 are electrically connected. The control unit (not shown) also controls movement of the tray 2.

In use, the tray 2 is placed beneath the enclosure 5 as shown in FIG. 1 and the airflow heater 38 is preheated to the requisite temperature, which corresponds to that which is required to provide a warm airflow in this embodiment. A vacuum pump (not shown) fluidly connected to the tray 2 and also controlled by the control unit (not shown) is then activated to provide a vacuum effect between the film 12 and the surface of the object 10. Initially, the level of vacuum is between 50 to 80 kPa to ensure that the object is fully coated with the film. When the film has been formed around the object, the vacuum is reduced to between 17 and 40 kPa.

The infrared heater 3 and the fan 40 are then activated simultaneously to heat the film to a temperature of between 90 and 140 degrees centigrade. The infrared radiation rapidly heats the film 12 while the airflow ensures a uniform temperature distribution by preventing so-called hot spots (i.e. isolated areas of high temperature). The fan 40 also breaks down the boundary layer over the film surface and therefore encourages efficient heat transfer between the air and the film.

Advantageously, the space between the tray 2 and the enclosure 5 allows the operator to see the progress of the thermoforming stage and set the apparatus 1 up to commence the sublimation stage at the appropriate time.

After the thermoforming stage is complete, the tray 2 is raised until it contacts and is substantially sealed against the enclosure 5 as shown in FIG. 2. The load provided by the airflow heater 38 and the infrared heater 3 is then increased to that which is required for the sublimation stage and the speed of the fan 4 is increased to provide a high flow rate.

As shown in FIG. 3, opposed portions of adjacent reflectors 36 cooperate to create a restriction in the flow of air resulting in a high velocity airstream, an airknife in this embodiment. The resulting highly turbulent flow of air causes the heat to be evenly distributed over the entire film and adjacent surface of the object. Thus, the combination of direct heating provided by the infrared heater 3 and the uniform temperature distribution provided by the hot flow of air results in a relatively short sublimation process step so as to avoid any damage to the integrity of the object 10.

On completion of the sublimation stage, the airflow heater 38 is disabled and the fan 4 continues to operate to provide the high velocity flow of non-heated air in order to cool the film 12 and the object 10. This further ensures that the integrity of the object 10 is maintained by minimising the length of time during which it is exposed to the sublimation conditions.

Figure 4:
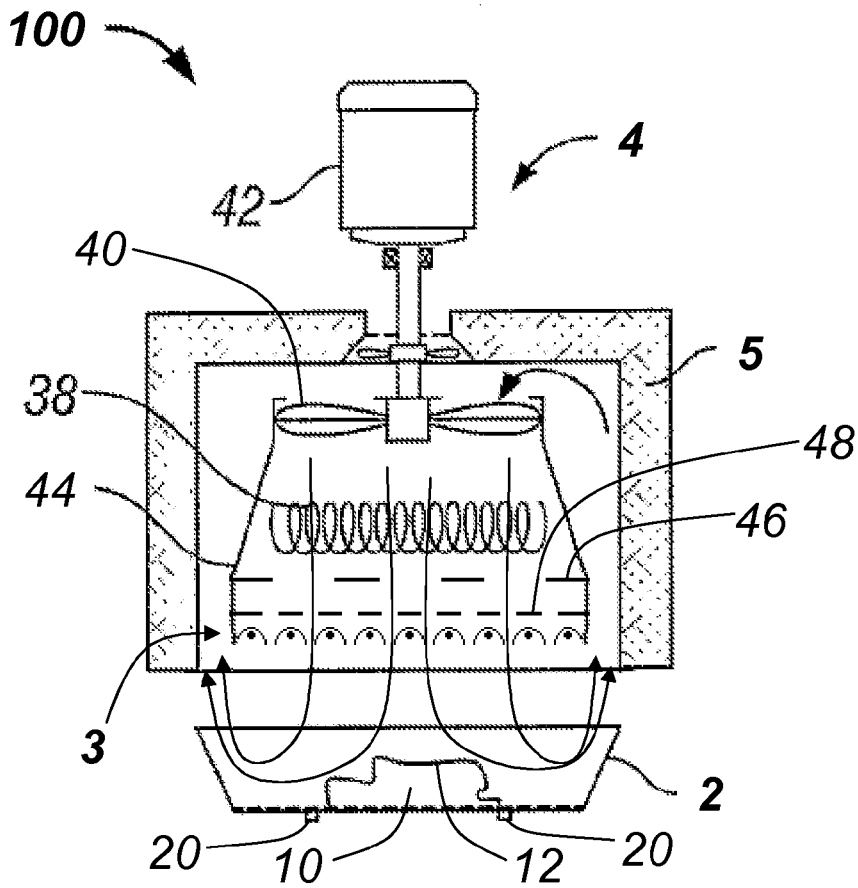
FIG. 4 is a diagrammatic section view through an ink sublimation printing apparatus in accordance with a second embodiment of the invention shown during the thermoforming stage.
Figure 5:
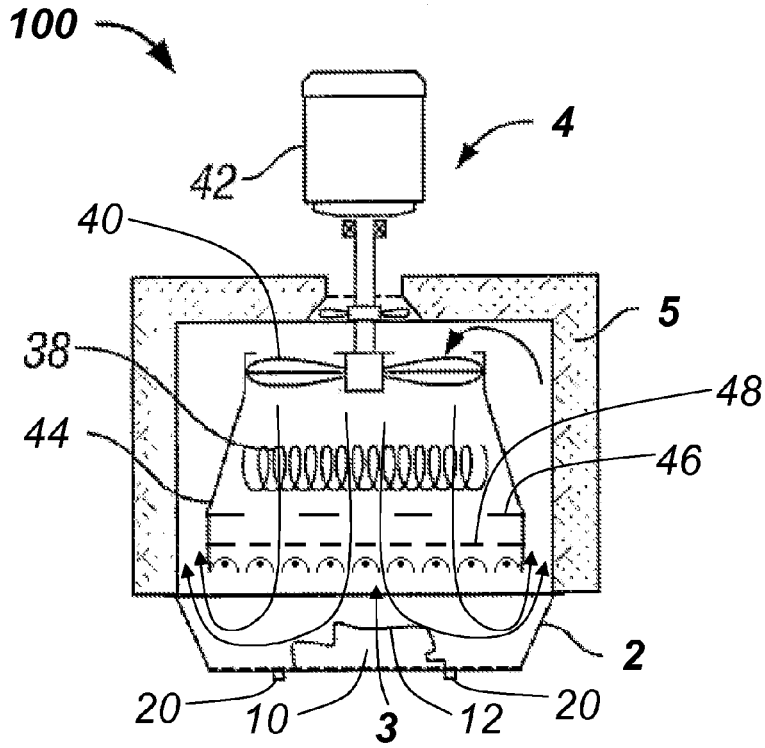
FIG. 5 illustrates the apparatus of FIG. 4 during the sublimation stage.
Figure 6:
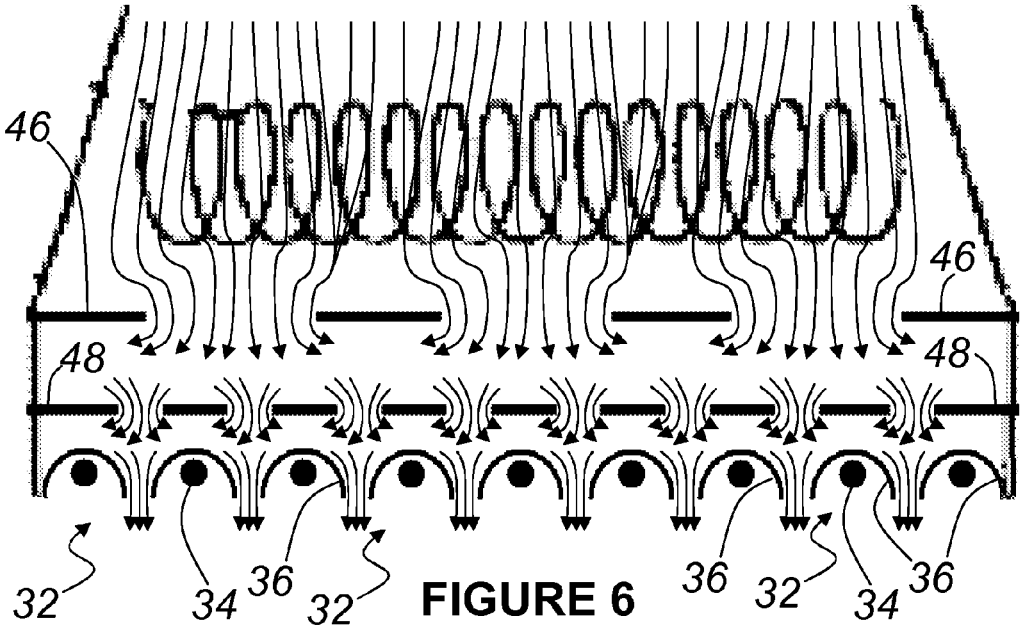
FIG. 6 is an enlarged view of the plenum arrangement of the apparatus of FIGS. 4 and 5 showing the flow of air therethrough.

Referring now to FIGS. 4 to 6, there is shown a second embodiment of the apparatus 100 according to the invention which is similar to the first embodiment, wherein like references represent like features and these will therefore not be described herein.

The apparatus 100 of FIG. 4 differs from the apparatus 1 of FIGS. 1 to 3 in that it includes a plenum 46, 48 formed of two parallel and spaced sheets 46 and 48. The first sheet 46 is located above the second sheet 48 and includes a plurality of equally spaced apertures therein. The second sheet 48 is located adjacent and slightly above the longitudinal infrared heaters 32 and includes a plurality of equally spaced apertures which are smaller and more numerous than the apertures in the first sheet 46. Thus, the plenum 46, 48 has progressively smaller and more numerous apertures which spread or distribute the flow of air more evenly across the film.

As shown more clearly in FIG. 6, this arrangement distributes the flow of air more evenly across the longitudinal infrared heaters 32, which in turn results in a more uniform flow over or across or onto the film 12 and the object 10.

Figure 7:
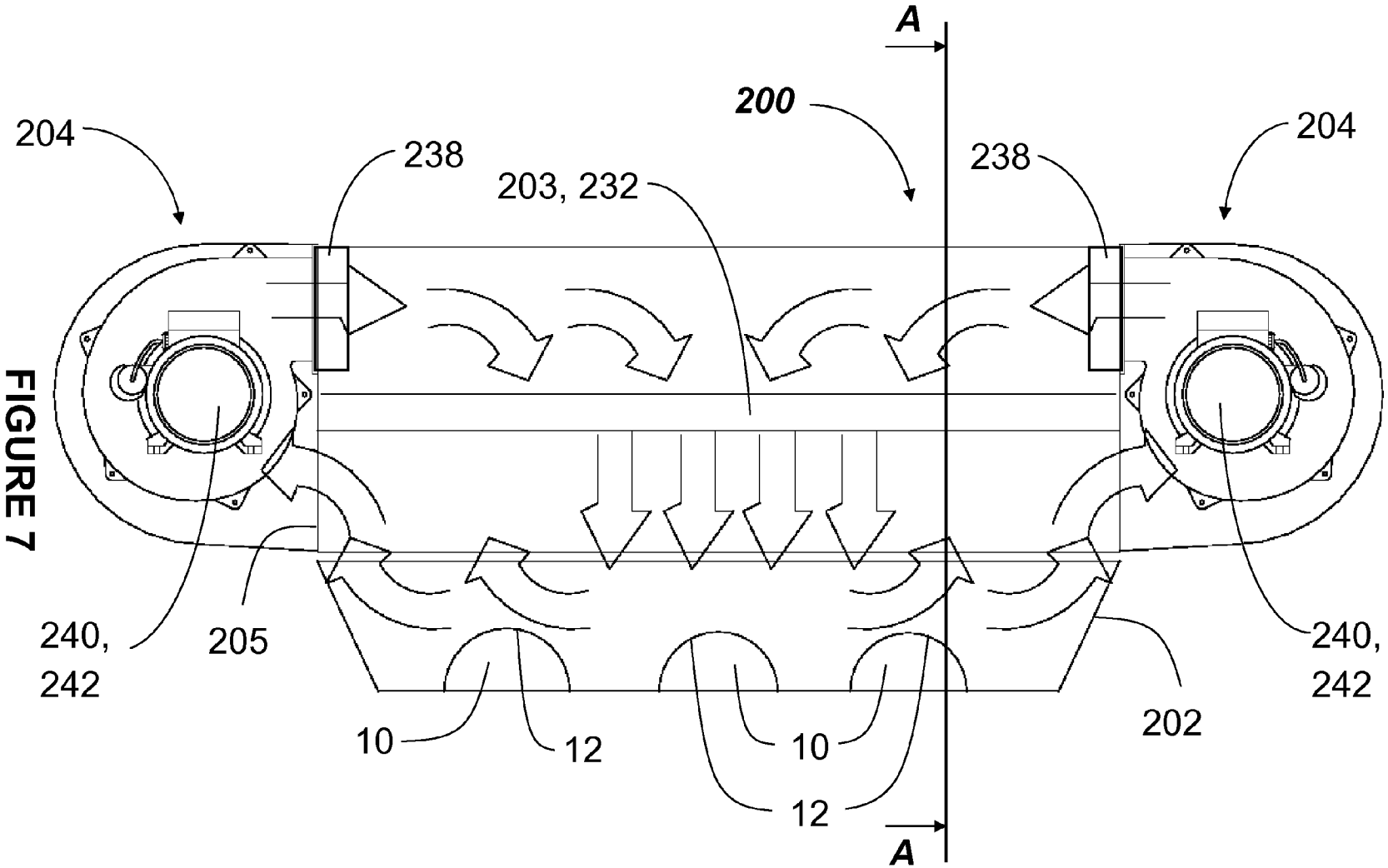
FIG. 7 is a diagrammatic section view through an ink sublimation printing apparatus in accordance with a third embodiment of the invention shown during the sublimation stage.

FIG. 7 shows a third embodiment of the apparatus 200 according to the invention which is similar to the aforementioned embodiments, wherein like references represent like features and these will therefore not be described herein.

Figure 8:
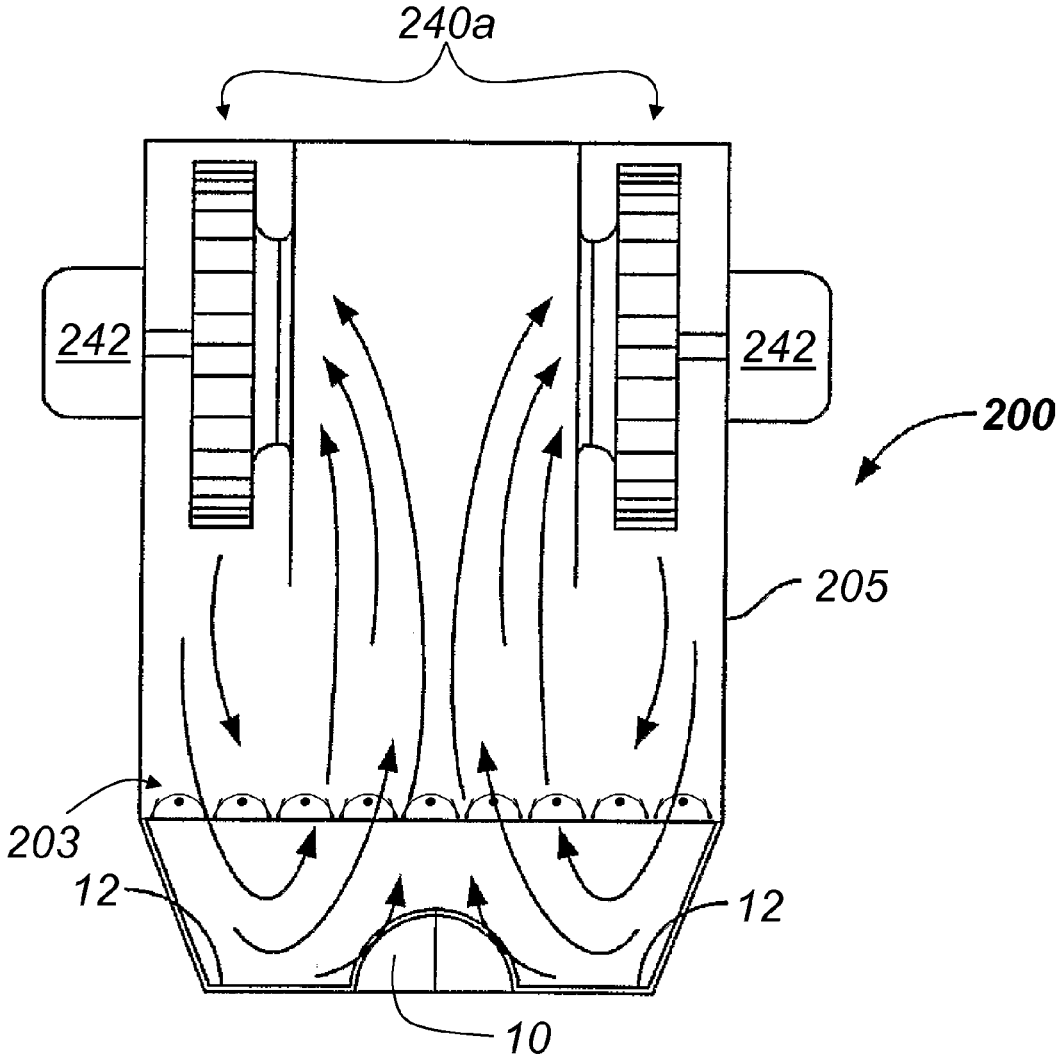
FIG. 8 is a section view through line A-A of FIG. 7 showing the recirculation path.

The airflow inducing means 204 of the apparatus 200 according to this embodiment includes four centrifugal fans 240, each of which is mounted to a respective corner of the enclosure 205. Each fan 240 is driven by a respective motor 242 and is arranged with its outlet facing horizontally across the length of the infrared heaters 3 and its inlet below them. Each fan 240 also includes a housing and a fan wheel 240*a*, wherein the pair of fan wheels 240*a* at each longitudinal end of the enclosure 205 have their inlets facing one another as shown more clearly in FIG. 8. This arrangement creates a positive pressure in the space above the heater 203, thereby forcing the air therethrough to generate the airknives. The flow of air follows generally the path shown in FIGS. 7 and 8, wherein the fan wheel pair 240*a* at each longitudinal end forces the air to flow through a respective airflow heater 238, from the lateral ends of the enclosure 205 toward the longitudinal centre thereof, thus generating a positive pressure and forcing airflow through the airknives and onto the object 10 and film 12. The flow then re-circulates through the inlet of the fans 240, into the inlet of the fan wheels 240*a* and back out as described above.

This fan arrangement is advantageous since a highly effective airflow can be achieved compactly and efficiently.

Figure 9A:
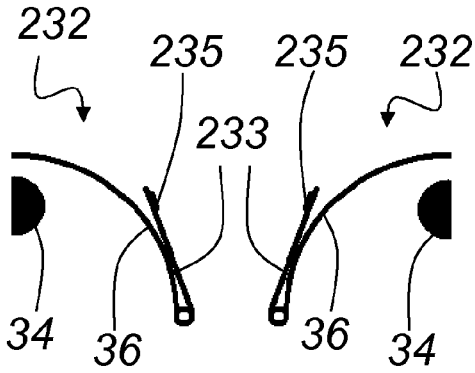
FIGS. 9A and 9B are enlarged views of the heater showing the function of the louver members.
Figure 9B:
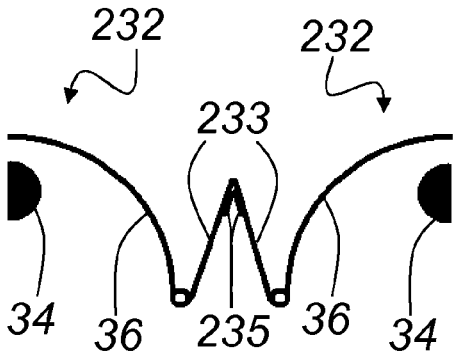

As shown more clearly in FIGS. 9A and 9B, the infrared heaters 203, 232 of the apparatus 200 also include opposed louver plates 233 which run along the length of the reflectors 36 and are hinged to their free edges for blocking or permitting the flow of air between them. The louver plates 233 include electromagnetic elements 235 adjacent their free edges for selectively opening or closing them to permit or prevent airflow between them.

In use, the louver plates 233 may be closed by energising the electromagnetic elements 235 such that they are attracted to one another, for example while the film 12 is being heated by the infrared heaters 232 and the vacuum is in operation during the thermoforming stage. The fans 240 and airflow heaters 238 may be in constant operation with the louver plates 233 in the closed position to provide hot air at a maximum pressure above the infrared heaters 232.

In order to initiate the sublimation stage, the polarity of the electromagnetic elements 235 is reversed to force the louver plates 233 apart, thus releasing the high pressure air between the reflectors 36 to create a sudden discharge or blast of air in the form of airknives onto the film 12 and the object 10. This may be done in isolation or in conjunction with infrared heating provided by the infrared heaters 232.

Figure 10:
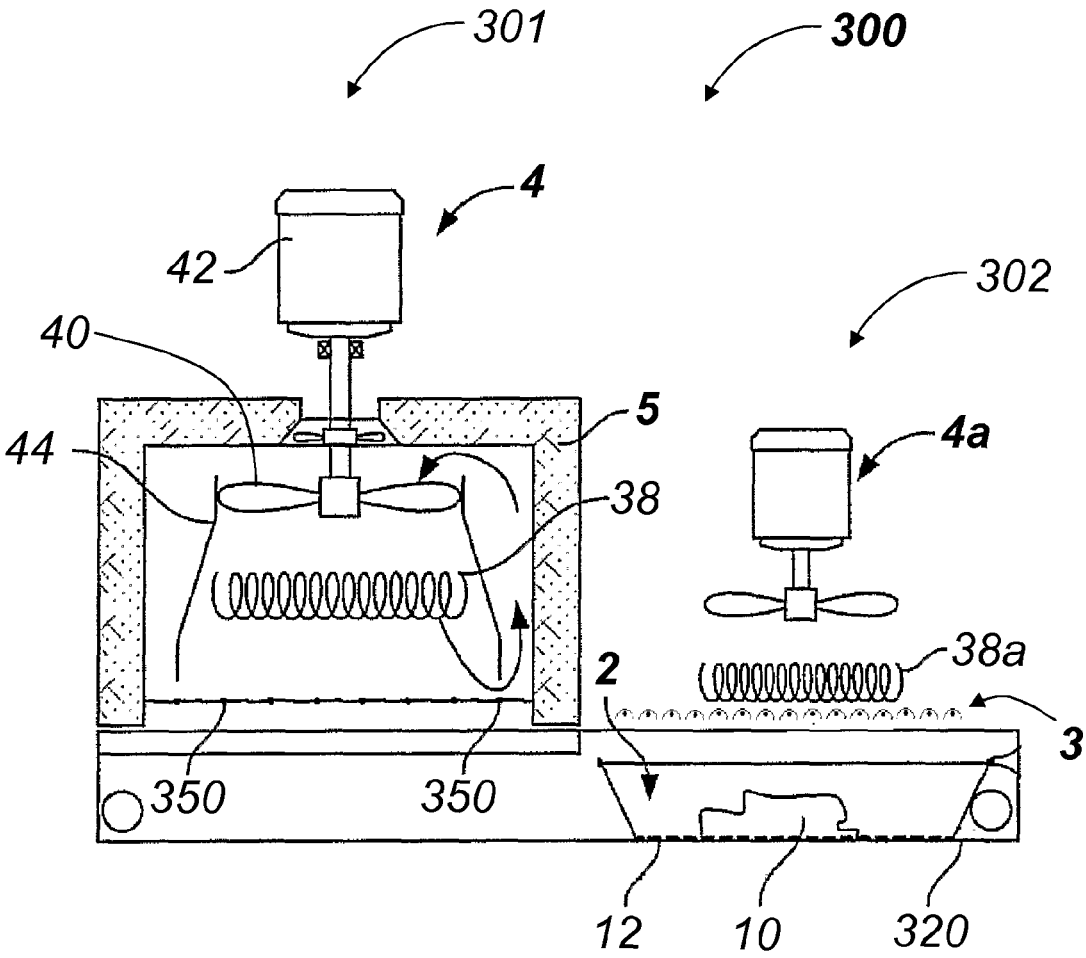
FIG. 10 is a diagrammatic section view through an ink sublimation printing apparatus in accordance with a fourth embodiment of the invention shown during the thermoforming stage.

FIG. 10 shows a fourth embodiment of the apparatus 300 according to the invention which is similar to the previous embodiments, wherein like references represent like features and these will therefore not be described herein.

The apparatus 300 according to this embodiment is divided into a two stations 301, 302 and a conveyor 320 for moving the tray 2 between each station 301, 302. The sublimation station 301 is similar to the apparatus 1, 100 of the first and second embodiments with the infrared heater 3 being replaced by a series of pivotable louvers 350. The thermoforming and cooling station 302 includes a blower 4*a* and airflow heater 38*a* similar to, but less powerful than, the blower 4 and airflow heater 38 of the sublimation station 301. This station 302 also includes an infrared heater 3 similar to the infrared heaters 3 in the first and second embodiments, which infrared heater 3 is below the airflow heater 38*a*.

In use, the tray 2 is positioned beneath the thermoforming and cooling station 302 and the thermoforming operation is carried out as described above in relation to the apparatus 1 of the first embodiment. Simultaneously, the airflow heater 38 and blower 4 of the sublimation station 301 are in operation while the louvers 350 are in a closed position. The tray 2 is then moved to a position beneath the sublimation station 301 by the conveyor 320 and is sealingly abutted to the enclosure 5 as described above in relation to the apparatus 1 of the first embodiment. The louvers 350 are then opened to create a sudden discharge or blast of air in the form of airknives onto the film 12 and the object 10. The blower 4 may advantageously be stopped or braked at the end of the sublimation stage in order to retain the latent heat within the enclosure 5.

Figure 11:
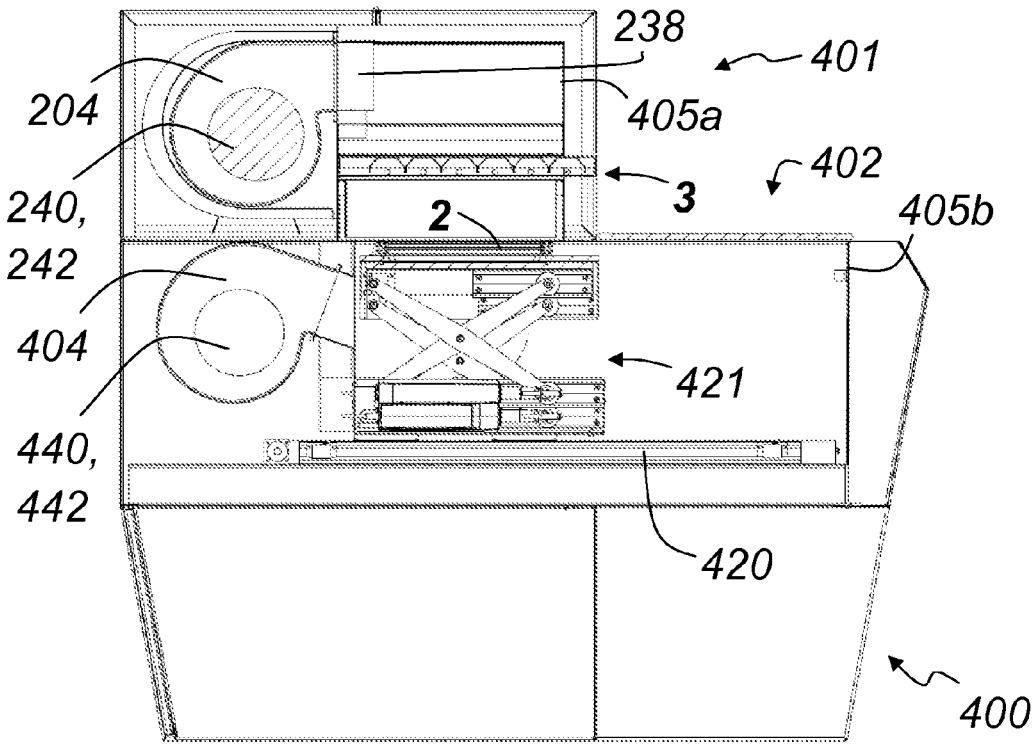
FIGS. 11 and 12 are diagrammatic section views through an ink sublimation printing apparatus in accordance with a fifth embodiment of the invention.
Figure 12:
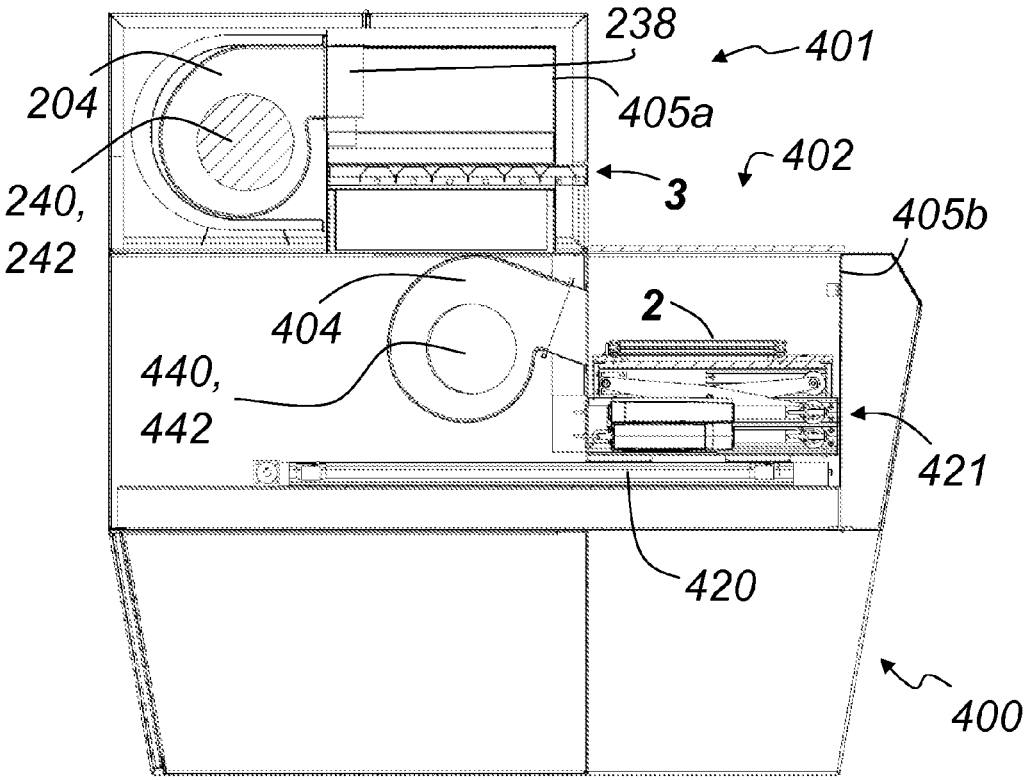

FIGS. 11 and 12 show a fifth embodiment of the apparatus 400 according to the invention which is similar to the previous embodiments, wherein like references represent like features and these will therefore not be described herein.

The apparatus 400 according to this embodiment is divided into a thermoforming and sublimation station 401 and a cooling station 402 with a conveyor 420 and scissor lift 421 for moving the tray 2 between each station 401, 402. The enclosure 405*a*, 405*b* is also divided into two compartments 405*a* and 405*b*, each of which encloses the tray 2 in one of the respective stations 401, 402. The thermoforming and sublimation station 401 is similar to the apparatus 200 of the third embodiment but with one of the fans 240, 242 removed. The cooling station 402 also includes an airflow inducing means 404 in the form of a centrifugal fan 440 powered by a motor 442, which fan 440 has an outlet 440*a* which is angled to direct ambient air onto and/or into the tray 2.

In use, the tray 2 is positioned beneath the thermoforming and sublimation station 401 and the thermoforming and sublimation operations are carried out as described above in relation to the apparatus 200 of the third embodiment. The tray 2 is then moved to a position beneath the cooling station 402 by the conveyor 320 and scissor lift 421 and the cooling fan 440 induces a flow of ambient air into the tray and/or over the parts to cool them.

It will be appreciated by those skilled in the art that several variations to the embodiments described herein are envisaged without departing from the scope of the invention. For example, whilst the heating elements 34 described above are coiled wire quartz tubes, these may be chosen based on the application in question and may include any form of quartz tubes, which come in several forms from coiled wire to carbon or combinations of the different types within the same double form tube. It is further envisaged that any other form of heating element 34 may be use such as halogen light bulbs and/or ceramic infrared emitters.

Whilst the apparatus 1, 100, 200, 300 includes a vacuum pump (not shown) fluidly connected to the tray, it is not necessary to provide such a vacuum effect for the invention to function. The airflow inducing means 4 and/or the infrared heater 3 need not operate during all of the thermoforming, sublimation and/or cooling stages and/or the temperature of the flow of air may be varied as required and/or the airflow heater 38 may be dispensed with altogether.

Moreover, the arrangement of louver plates 233 provided as part of the infrared heater 3 may be configured in a number of different ways, for example by having sliding plates, plates which are hinged to an upper side of the reflectors 36 or any other louver arrangement. The louvers 350 in the fourth embodiment may be replaced with an infrared heater 203 as shown and described in relation to the third embodiment to create airknives, which infrared heater 203 may or may not include actual heating elements 34. The apparatus may also be provided with a separate series of louvers between the airflow inducing means 4 and the infrared heater 3 for selectively preventing the flow of air to the object as also described in the aforementioned document. The location of the airflow inducing means 4 may also be varied, for example it may include a combination of a blower or blowers and/or centrifugal fans and/or any other suitable means or device for generating the desired airflow. The conveyor 320, 420 and/or scissor lift 402 may be replaced by any convenient moving, e.g. conveying and/or lifting and/or rotation means.

It will be appreciated by those skilled in the art that any number of combinations of the aforementioned features and/or those shown in the appended drawings provide clear advantages over the prior art and are therefore within the scope of the invention described herein.

The invention claimed is:

1. A sublimation printing apparatus comprising a substrate for receiving a three dimensional object having a film carrying sublimable ink thereon, an infrared heater mounted adjacent the substrate and airflow inducing means, wherein the infrared heater is operable to direct infrared radiation toward the substrate, the airflow inducing means being operable to induce a flow of air onto and/or over and/or across the film.

2. Apparatus according to claim 1, wherein the airflow inducing means is positioned to induce a flow of air through or around the infrared heater, the infrared heater being shaped to restrict the airflow to create a high velocity airstream.

3. Apparatus according to claim 2 further comprising louver means for selectively opening or closing the flow of air through the infrared heater.

4. Apparatus according to claim 2, wherein the infrared heater comprises a heating element at least partially surrounded by a reflector, wherein the reflector is shaped to at least partially restrict the airflow to create an airknife.

5. Apparatus according to claim 4, wherein the infrared heater comprises a second heating element at least partially surrounded by a second reflector which is adjacent but separate from the first reflector to provide a gap therebetween, the airflow inducing means being positioned to induce a flow of air through the gap.

6. Apparatus according to claim 4, wherein the portion of the reflector or reflectors which at least partially causes the airknife is tapered or convex.

7. Apparatus according to claim 4, further comprising one or more louver plates slidably or pivotably connected to the reflector or reflectors for selectively opening or closing the flow of air through the infrared heater.

8. Apparatus according to claim 5, wherein the gap is between 1 and 2 millimeters.

9. Apparatus according to claim 1, further comprising an airflow heater adjacent the airflow inducing means for heating the flow of air.

10. Apparatus according to claim 9, wherein the airflow heater is adjustable to provide air flow at two or more different temperatures.

11. Apparatus according to claim 1, wherein the airflow inducing means is operable to provide two or more different flow velocities.

12. Apparatus according to claim 11, wherein the airflow inducing means comprises a fan or a blower with an inverter for providing the two or more different flow velocities.

13. Apparatus according to claim 1, wherein the airflow inducing means comprises at least one pair of opposed centrifugal fans positioned with their outlets above the infrared heater and their inlets below the infrared heater.

14. Apparatus according to claim 13 further comprising an enclosure above or around the infrared heater, wherein the fans are positioned at opposite ends or sides of the enclosure.

15. Apparatus according to claim 14, wherein the fans are positioned at opposite lateral sides of the enclosure with their inlets facing one another.

16. Apparatus according to claim 15 further comprising a second pair of opposed centrifugal fans positioned at the opposite longitudinal end of the enclosure to the first pair of fans, the inlets of the second pair of fans being located below the infrared heater and the outlets of the second pair of fans being located above the infrared heater and facing the outlets of the first pair of fans.

17. Apparatus according to claim 1, further comprising a control unit for controlling the operation of the infrared heater and/or the airflow inducing means and/or the airflow heater and/or the louver means or plates.

18. Apparatus according to claim 1, further comprising a plenum for distributing or spreading the or a flow of air from the airflow inducing means across the film.

19. Apparatus according to claim 18, wherein the plenum comprises two or more plates having progressively smaller and more numerous apertures for spreading or distributing the flow of air more evenly across the film.

20. A film carrying sublimable ink in combination with an apparatus according to claim 1.

21. A method of sublimation printing comprising placing a film carrying sublimable ink adjacent an object, heating the film to a first temperature such that it thermoforms over a surface of the object and subsequently heating the film and/or the object to a second, higher temperature such that the ink sublimates to the object, wherein the film and/or the object is exposed to infrared heat during one or both of the heating stages and to a flow of air during or after one or both of the heating stages.

22. Method according to claim 21, wherein the film and/or the object is exposed to infrared heat to heat it to the first temperature and to a high velocity flow of heated air to heat it to the second, higher temperature.

23. Method according to claim 21, wherein the film is exposed to a low velocity flow of air at a first temperature during the thermoforming stage and to a high velocity flow of air at a second higher temperature during the sublimation stage.

24. Method according to claim 21, wherein the film and/or object is exposed to a non-heated high velocity flow of air after the sublimation stage for cooling the object and film.

25. Method according to claim 21, wherein the flow of air comprises an airknife.

26. Method according to claim 25, wherein the airknife is created by cooperating adjacent portions of the infrared heater which cause a restriction.

* * * * *